US007111979B2

(12) United States Patent
Kaelin

(10) Patent No.: US 7,111,979 B2
(45) Date of Patent: Sep. 26, 2006

(54) CONTROL DEVICE WITH MULTIPLE AXIAL POSITIONS FOR ELECTRONIC APPARATUS

(75) Inventor: Laurent Kaelin, Sonvilier (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 323 days.

(21) Appl. No.: 10/742,780

(22) Filed: Dec. 23, 2003

(65) Prior Publication Data

US 2004/0136275 A1 Jul. 15, 2004

(30) Foreign Application Priority Data

Dec. 31, 2002 (EP) ..... 02080681

(51) Int. Cl.
*G04B 37/00* (2006.01)

(52) U.S. Cl. ..... 368/308; 368/321

(58) Field of Classification Search ..... 368/59, 368/204, 190, 320–321
See application file for complete search history.

(56) References Cited

U.S. PATENT DOCUMENTS

| | | | | |
|---|---|---|---|---|
| 1,909,783 | A | 5/1933 | McWhirter | |
| 3,145,275 | A | 8/1964 | Gildart | |
| 3,832,843 | A | 9/1974 | Wuthrich | |
| 4,409,448 | A | 10/1983 | Matsui et al. | |
| 5,305,291 | A | 4/1994 | Kamens et al. | |
| 6,203,190 | B1 | 3/2001 | Stotz | |
| 6,896,403 | B1 * | 5/2005 | Grau | 368/190 |
| 2001/0053109 | A1 * | 12/2001 | Ehrsam et al. | 368/190 |

FOREIGN PATENT DOCUMENTS

| | | |
|---|---|---|
| CH | 244267 | 8/1946 |

* cited by examiner

*Primary Examiner*—Kamand Cuneo
*Assistant Examiner*—Sean Kayes
(74) *Attorney, Agent, or Firm*—Sughrue Mion, PLLC

(57) ABSTRACT

The present invention concerns a control device for electronic apparatus of the electronic stem type, adapted to be shifted between a plurality of axial positions. According to one preferred embodiment, the stem (1), with axis X, has four different axial positions. Two contact clips (21, 22, 60, 61) mutually offset in the direction of the axis X are provided to make contact with two respective power supply terminals (19, 20, 75, 76) of a source of electrical power supply. The stem comprises a plurality of cylindrical portions (36, 38, 50, 51, 52) which cooperate with deformable extensions (27, 28, 64, 65) of the contact clips to deform them in a direction substantially perpendicular to the axis X. Thus, in accordance with the axial position of the stem (1), the contact clips (21, 22, 60, 61) can be in different electrical states, i.e. isolated or connected to the source of power supply, independently of one another. As a result the assembly formed by the two contact clips can exhibit four different states, each being representative of a given axial position of the stem.

13 Claims, 6 Drawing Sheets

(Pos 2)

CONTROL DEVICE WITH MULTIPLE AXIAL POSITIONS FOR ELECTRONIC APPARATUS

FIELD OF THE INVENTION

The present invention relates to a control device for electronic apparatus, comprising a stem with an axis X, adapted to be shifted between at least two axial positions, a first movable contact element and a first electric power supply terminal.

More particularly, the present invention concerns a control device of the electronic stem type adapted to be implemented in an electronic watch, or in any other similar portable electronic apparatus requiring means for entry of data.

BACKGROUND OF THE INVENTION

Many devices of this type are already known from the prior art.

However, the present invention provides a structure which is simple to implement and which allows in particular, according to one preferred embodiment, provision of up to four different axial positions of the stem with only two movable contact elements necessary to distinguish between these different positions.

U.S. Pat. No. 6,203,190, issued 20th Mar. 2001 in the name of Timex, describes an electronic stem having four different axial positions. To this end it is provided that the stem comprises an annular groove, in which is fitted a tongue integral with a contact collar mounted, near to the stem, rotatably about an axis orthogonal to the axis of the stem. When the stem is displaced into its different axis positions, the groove entrains the tongue, whose displacement causes the contact collar to rotate. Moreover the collar carries a second tongue, whose free end is located opposite a plurality of electric contact pads which are formed at the end of electrically conductive tracks. When the contact collar turns in response to axis displacement of the stem, the second tongue moves from one contact pad to the other, the second tongue being so shaped that its free end is disposed in contact with the contact pads.

The structure of the control device shown in this patent is however complex to realise, in particular because of the number of different elements which are needed for its operation and because the relative positioning of some of these elements needs to be precise. Furthermore, this structure has a significant size and requires implementation of an electric contact track-pad assembly for each axial position of the stem. Moreover the device described can exhibit problems of wear related to poor ageing with time because of its mode of operation. Thus, a plurality of constituent elements of this device are arranged to slide while rubbing on one another—the contact collar on its support and the free end of the second tongue on the contact pads—which gives rise to significant wear in the course of operation. Furthermore the rubbing can release small particles of matter which are prone to interfere with the operation of the device in the long term.

SUMMARY OF THE INVENTION

A principal object of the present invention is to alleviate these problems of the prior art referred to above by providing a structure for a control device for electronic apparatus, which is simple to implement, reliable and with a good performance over time.

To this end, the invention concerns a control device for electronic apparatus of the type described above, characterised in that the stem has at least two axial portions with respective different cross-sections, of which at least one is adapted to cooperate with the contact element in such a manner that the latter has different distances from the axis X in dependence on the axial position assumed by the stem, contact being established between the contact element and the power supply terminal in one of the two axial positions.

Because of its simple kinematics, such a structure allows realisation of a reliable device, exhibiting only little wear over time, as well as reduced size.

In a preferred embodiment, the movable contact element is realised in the form of a part of a contact clip of elastic conductive material, adapted to make contact with a part of the stem with a large cross-section. The shape of the contact element is so adapted that, in this position of the stem, it is deformed and is thus under mechanical tension, tending to return to its position of rest, i.e. in the direction towards the axis X of the stem. Thus, when the stem is moved into another axial position, in such a manner that a part with a smaller cross-section faces the movable contact element, this moves towards the stem because of its elastic properties.

BRIEF DESCRIPTION OF THE DRAWINGS

Other features and advantages of the present invention will appear more clearly from a reading of the detailed description which follows, with reference to the accompanying drawings, given by way of non-limiting example and in which.

Figure 1:
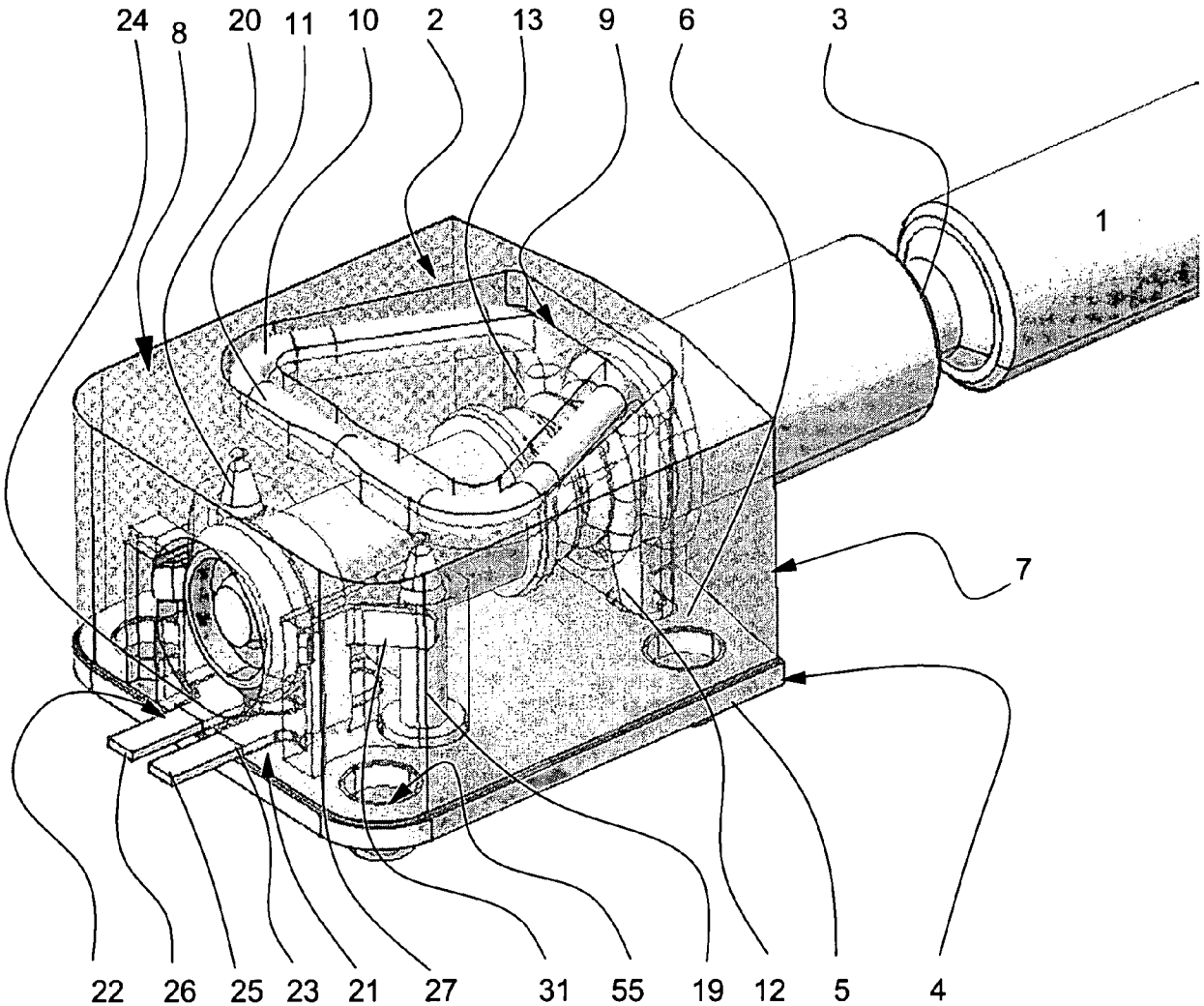
FIG. 1 shows a perspective view of the control device according to a first preferred embodiment, in which two movable contact elements are provided.

The contents of the Figures have deliberately been limited essentially to the showing of the features involved in the present invention, in order to aid understanding.

DETAILED DESCRIPTION OF THE PREFERRED EMBODIMENTS

The following description relates to a specific embodiment in which the stem 1 has two stable "pulled-out" positions and an unstable "pushed-in" position, as well as a rest or neutral position, which is also stable.

The control device according to the present embodiment is made in the form of a module 2, into which one end of the stem enters, the stem being shown only partially. The second end of the stem 1 (not shown) is adapted to receive a graspable member of crown type. It is noted in FIG. 1 that the stem 1 has an annular groove 3 located outside the module 2. The annular groove 3 is in fact intended to receive a ring seal (not shown) to ensure tightness of an opening formed in the case of the electronic apparatus in which the control device according to the present invention is implemented.

The module 2 comprises a support plate 4, here having two layers assembled one on the other. A first, lower layer 5 made from an electrically conductive material is provided for connection to a first terminal of a source of electrical power supply (not shown) of the electronic apparatus. The second layer 6 is made from an electrically insulating material and serves as a support for fixing a plurality of the components of the control device.

The module 2 further comprises a cover 7 covering the assembly of the control device located on the support plate 4. The upper face 8 of the cover 7 has a recess 9 of special shape, forming a seat for an open spring 10. The spring 10 has a particular form, known in the prior art, adapted to hold the stem 1 in its three stable axial positions. Thus, the spring 10 has a first part 11 forming a base, substantially flat and located in the thickness of the face 8 of the cover 7 facing the plate 4, while its two free ends 12 and 13 extend into the module 2, on one side and the other of the stem 1. The latter has three adjacent annular grooves 14, 15 and 16, separated by beads 17 and 18 with substantially rounded profiles (also visible in the following figures). The dimensions of the grooves 14 and 16 are matched to those of the free ends 12 and 13 of the spring 10, such that, when the stem (shown here in its neutral position) is shifted into its pulled-out positions, the ends 12 and 13 of the spring 10 spread and slide on the bead 17 or 18 before latching into one of the grooves 15 and 16 of the stem 1.

The plate 4 carries two connector studs 19 and 20 arranged on one side and the other of the stem 1, each mounted by a base (not shown) passing through an opening in the second layer 6 and extending into the first layer 5 in order to effect both mechanical support of the corresponding stud and its electrical connection to the source of electrical power supply.

The plate 4 further carries contact clips 21 and 22, each being fixed on the plate 4 by an elongated base 23, 24, essentially facing the stem 1. Respective ends 25, 26 of the bases 23, 24 extend outside the module 2 through openings adapted thereto in the cover 7 and are provided for connection to the electronic circuits of the apparatus in which the control device is mounted. Each of the contact clips 21, 22 further comprises a bent side extension 27 and 28 inclined at an angle slightly less than 90 degrees, in the direction of the stem 1, relative to the plate 4. The extensions 27 and 28 extend to one side and the other respectively, up to a level located substantially at mid height of the stem 1.

Each of the extensions comprises tongues 31, 32 and 33, 34 at its end 29, 30, extending in a direction substantially parallel to the plate 4 and inclined at opposite respective angles relative to the axis of the stem 1. The tongues 31, 33 have similar lengths, such that their respective ends face the connector studs 19 and 20 respectively while the other two tongues 32 and 34 are shorter.

The region of the stem located in the region of the extensions 27 and 28 of the contact clips has several successive portions of different respective cross-sections, whose respective functions will be explained below with reference to FIGS. 2 and 3.

These Figures thus allow the functioning of the present embodiment of the invention to be better understood, in that the control device is shown in a view from above.

Figure 2:
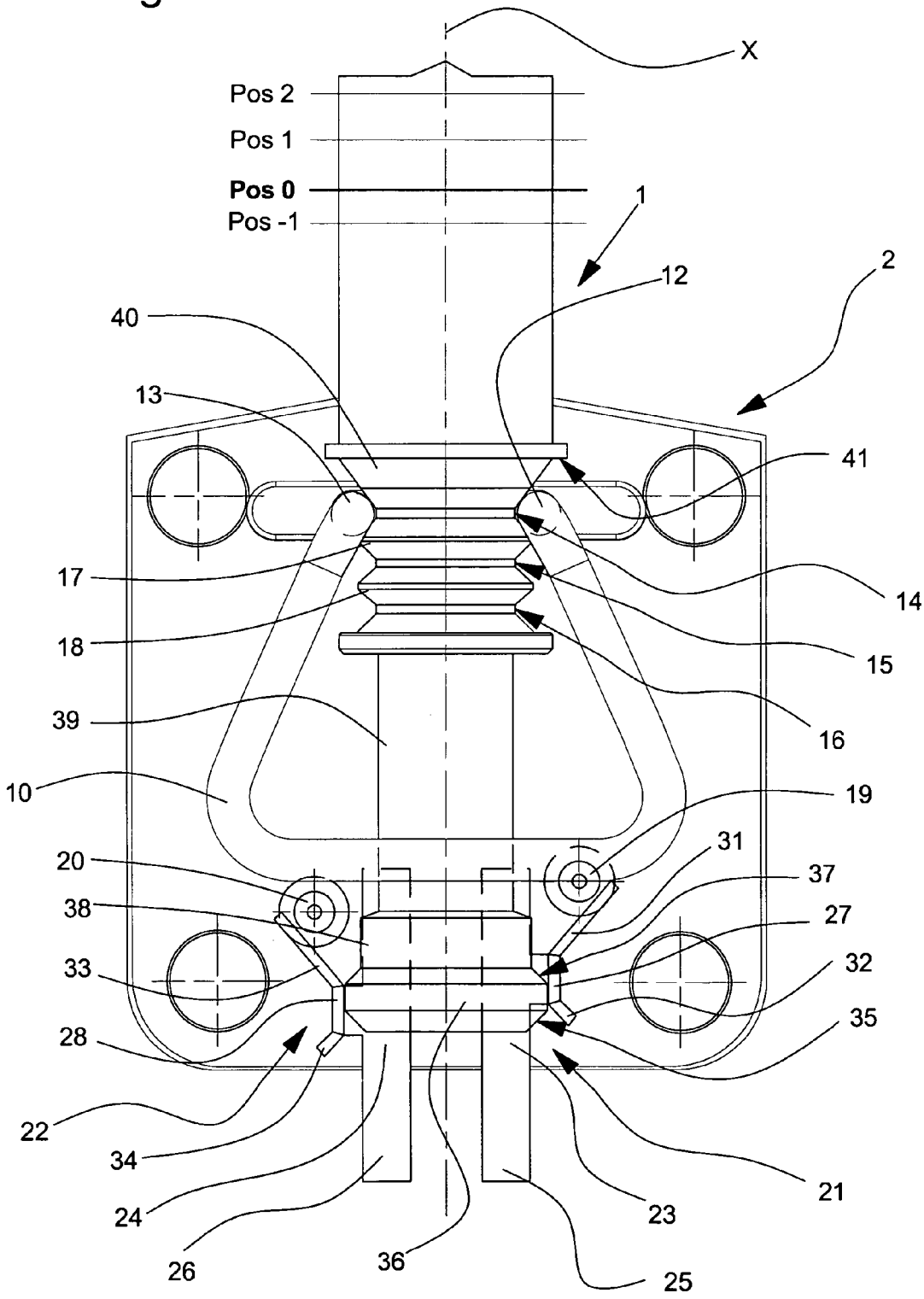
FIG. 2 is a simplified view from above of the control device of FIG. 1.

It is noted that, in FIG. 2, the extensions 27 and 28 are offset from one another in the direction of the axis X of the stem 1, like the connector studs 19 and 20. However the respective relative positions of the connector stud 19 and the extension 27 and of the connector stud 20 and the extension 28 are similar.

Starting from its end located inside the module 2, the stem has a first, frustoconical portion 35 followed by a second, cylindrical portion 36 of cross-section S1. A third, frustoconical section 37 of opposite slope to that of the first portion 35, relative to the axis X, connects the second, cylindrical portion 36 to a fourth portion 38, also cylindrical, with a cross-section S2 smaller than S1.

It can be seen from this view that the first and third frustoconical portions 35 and 37 have angles similar to those of the tongues 31 to 34 relative to the axis X of the stem 1.

The stem 1 is made—in a preferred but not limiting manner—from a material of metallic type so far as its body is concerned, for obvious reasons of mechanical resistance, while a greater part of its end located inside the module 2 is covered by a sleeve 39 formed by moulding a plastics material. Implementation of such a structure making use of a sleeve leads to great flexibility in the manufacturing process, to the extent that the form of the sleeve can be modified according to the wishes of the manufacturer with some flexibility, while keeping to a single base for making the body of the stem.

As mentioned above, the stem has been shown in its "rest position" in FIG. 2, that is to say a neutral position in which it typically does not perform any particular function. It is further adapted to be moved into 3 supplementary axial positions, of which two are stable "pulled-out positions" and one is an unstable "pushed-in position". As will be seen below, the present control device comprises means described above, the operation of which allows determination of which position the stem 1 is situated at each instant.

When the stem is in the neutral position, such as is shown by the indication Pos 0 in FIG. 2, it is seen that the extensions 27 and 28 are both in contact with the second portion 36 of the stem 1. Furthermore it is apparent from the Figure that, in such a position, the tongue 31 is not in contact with the connector stud 19, the tongue 33 no longer being in contact with the connector stud 20 either. Thus the two contact clips 21 and 22 are isolated from the electrical point of view. Moreover it may be noted that the latter are shaped during their manufacture in such a manner that they are subject to mechanical stress in the configuration of FIG. 2, i.e. a restoring force tends to keep them in contact with the stem 1.

When the stem 1 is pressed by an operator towards its pushed-in position, denoted Pos −1, the cylindrical portion 36 slides between the two extensions 27 and 28, in a first direction. When the third frustoconical portion 37 comes opposite the short tongue 32, the extension 27 moves in the direction of the stem 1 because of its restoring force, to the extent that the stem is pushed-in. The extension 28 simply slides along the cylindrical portion 36, remaining facing this, because of its offset along the axis X relative to the extension 27.

At the same time the free ends 12 and 13 of the spring 10 slide along a fifth, frustoconical portion 40 of the sleeve 39, up to an annular shoulder 41 forming a stop for the pushed-in position of the stem. The spring 10 is then under tension and tends to return the stem into its neutral position, through the elastic action of the free ends 12 and 13 on the frustoconical portion 40 of the sleeve 39.

When the stem 1 is in the pushed-in position, the extension 27 comes into contact with the cylindrical portion 38, because of its restoring force. As a result the tongue 31 integral with the extension 27 undergoes the same displacement in the direction of the stem and comes into contact with the connector stud 19. Thus the contact clip 21 is raised to the potential of the terminal of the source of electrical power supply connected to the first layer 5 of the plate 4, the contact clip 22 remaining isolated. This electric potential is then transmitted to the electronic circuits of the apparatus via the end 25 of the contact clip 21.

On the other hand, when departing from its neutral position, the stem 1 is pulled towards its first pulled-out position denoted Pos 1 in FIG. 2, the cylindrical portion 36 slides between the extensions 27 and 28 in a second direction, opposite to the first direction referred to above. Conversely to what happens when the stem is pushed-in, the extension 28 reaches the end of the portion 36 while the extension 27 is still at its level.

Once the stem is in its first pulled-out position, located by the cooperation of the free ends 12 and 13 of the spring 10 with the groove 15, the extension 27 is still in abutment with the portion 36 while the extension 28 is no longer facing the stem 1. Thus the extension 28 turns back in the direction of the axis of the stem, because of its restoring force, until the tongue 33 comes into contact with the connector stud 20. In the first pulled-out position of the stem, the contact clip 22 is thus raised to the potential of the terminal of the source of electrical power supply, via the connector stud 20 and the first layer 5 of the plate 4, while the contact clip 21 remains isolated from the electrical point of view. Thus this electric potential is applied to the electronic circuits of the apparatus via the end 26 of the contact clip 22.

Figure 3:
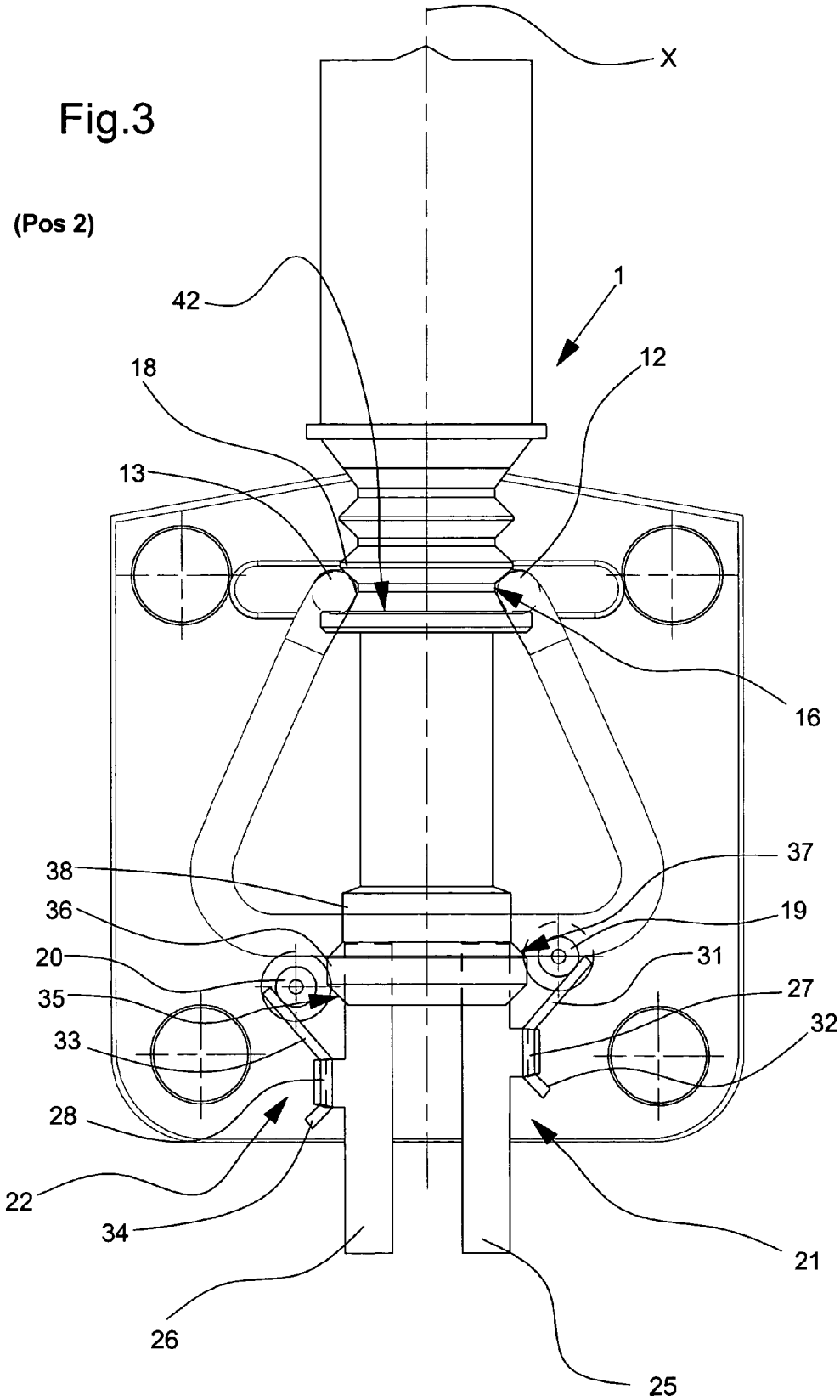
FIG. 3 is view similar to the view of FIG. 2, in which the stem of the control device is located in a different axial position from that of FIG. 2.

When the operator pulls the stem 1 further so as to move it into its second pulled-out position, denoted Pos 2 in FIG. 2 and illustrated in FIG. 3, the free ends 12 and 13 of the spring 10 spread temporarily away from one another to overcome the bead 18, before lodging in the annular groove 16 of the stem and ensuring that the stem is kept stable in this position. An annular shoulder 42 is provided on the stem to form a stop for the displacement of the stem in this direction.

During this operation the contact clip 28 does not undergo any change of its state relative to the first pulled-out position of the stem. Thus, as described previously for the first pulled-out position, the tongue 33 comes into constant abutment with the connector stud 20 as the extension 28 is already no longer in contact with the stem.

On the other hand, it is noted that the extension 27 of the contact clip 21, which was still in contact with the stem 1 in the first pulled-out position of the latter, is no longer positioned facing the stem in the second pulled-out position and turns back in the direction of the axis of the stem, because of its restoring force. As a result the tongue 31 is in contact with the connector stud 19 and the contact clip 21 is raised to the potential of the terminal of the source of electrical power supply of the apparatus connected to the first layer 5 of the plate 4.

Thus, in the second pulled-out position of the stem 1, the contact clips 21 and 22 are simultaneously raised to the potential of the terminal of the source of power supply and pass this potential to two different inputs (not shown) of the electronic circuits of the apparatus by the bias on their respective ends 25 and 26.

In summary, the respective states of the contact clips 21 and 22 can be represented in a table, as a function of the axial position of the stem 1, symbolising the isolated state of a clip by 0 and the state when it is connected to the source of power supply by 1.

| Position of the stem 1 | Contact clip 21 | Contact clip 22 |
|---|---|---|
| Pos −1 | 1 | 0 |
| Pos 0 | 0 | 0 |
| Pos 1 | 0 | 1 |
| Pos 2 | 1 | 1 |

Thus, in considering the assembly formed by the two contact clips 21 and 22, it is noted that it exhibits four different states associated respectively with four respective positions of the stem 1. Accordingly this structure advantageously allows provision of only two conductor tracks to the electronic circuits of the apparatus in order to distinguish an axial position of the stem among four possible positions.

The electronic circuits of the apparatus comprise conventional detecting means for these four different states, such as an integrated circuit, to which the respective ends 25, 26 of the contact clips 21, 22 are connected. These detection means, as well as the electronic circuits of the apparatus in general do not form part of the present invention and will thus not be described in more detail. The man skilled in the art will not encounter any difficulty in finding the information necessary for their implementation.

It is further apparent from FIGS. 2 and 3 that the respective inclinations of the tongues 31 to 34 relative to the axis of the stem allow the operation of the control device which has been described to be improved. Thus, these various angles correspond substantially to the angles presented by the frustoconical parts 35 and 37 of the stem relative to the axis X of the latter. This particular feature improves the sliding between the contact clips 21, 22 and the stem 1, by reducing friction of the extensions 27 and 28 on the various junctions separating the cylindrical portions from the frustoconical portions of the stem.

By way of example and referring to FIG. 3, with the stem in its second pulled-out position, it is apparent that, when the stem is pushed back into its first pulled-out position, the contact clip 21 makes contact again with the stem 1, via the frustoconical portion 35. To the extent that the initial contact takes place in the region of the tongue 31, the fact that the respective inclinations of the frustoconical portion 35 and of the tongue 31 relative to the X axis of the stem are similar is an advantage, since the transmission of the translation of the stem to the contact clip 21 is effected through sliding of two substantially parallel surfaces. Such a kind of sliding is clearly preferable to the sliding of an arris on an inclined plane.

Likewise, with reference to FIG. 2, assuming that the stem 1 has been pushed into its position denoted Pos −1 and is released to return to its neutral axial position, the same type of phenomenon as described above occurs between the tongue 32 and the frustoconical portion 37 of the stem. Thus, in the pushed-in axial position, the extension 27 is in contact with the cylindrical portion 36 of the stem 1, the tongue 31 being in contact with the connector stud 19. When the stem is released, it returns in the direction its neutral axial position under the action of the spring 10. When the frustoconical portion 37 of the stem comes into contact with the tongue 32 of the contact clip 21, the translation of the stem causes sliding of the tongue on the frustoconical portion, involving deformation of the clip 21 in such a manner as to move the extension 27 away from the axis of the stem with friction of small amount. Obviously, this operation could be realised without the presence of the tongue 32, which would make the arris of the extension 27 slide on the frustoconical portion 37, but this involves markedly greater friction between the latter two elements. Such a solution implemented without the tongue 32 thus proves to be less advantageous from the point of view of wear related to repeated use.

Figure 4:
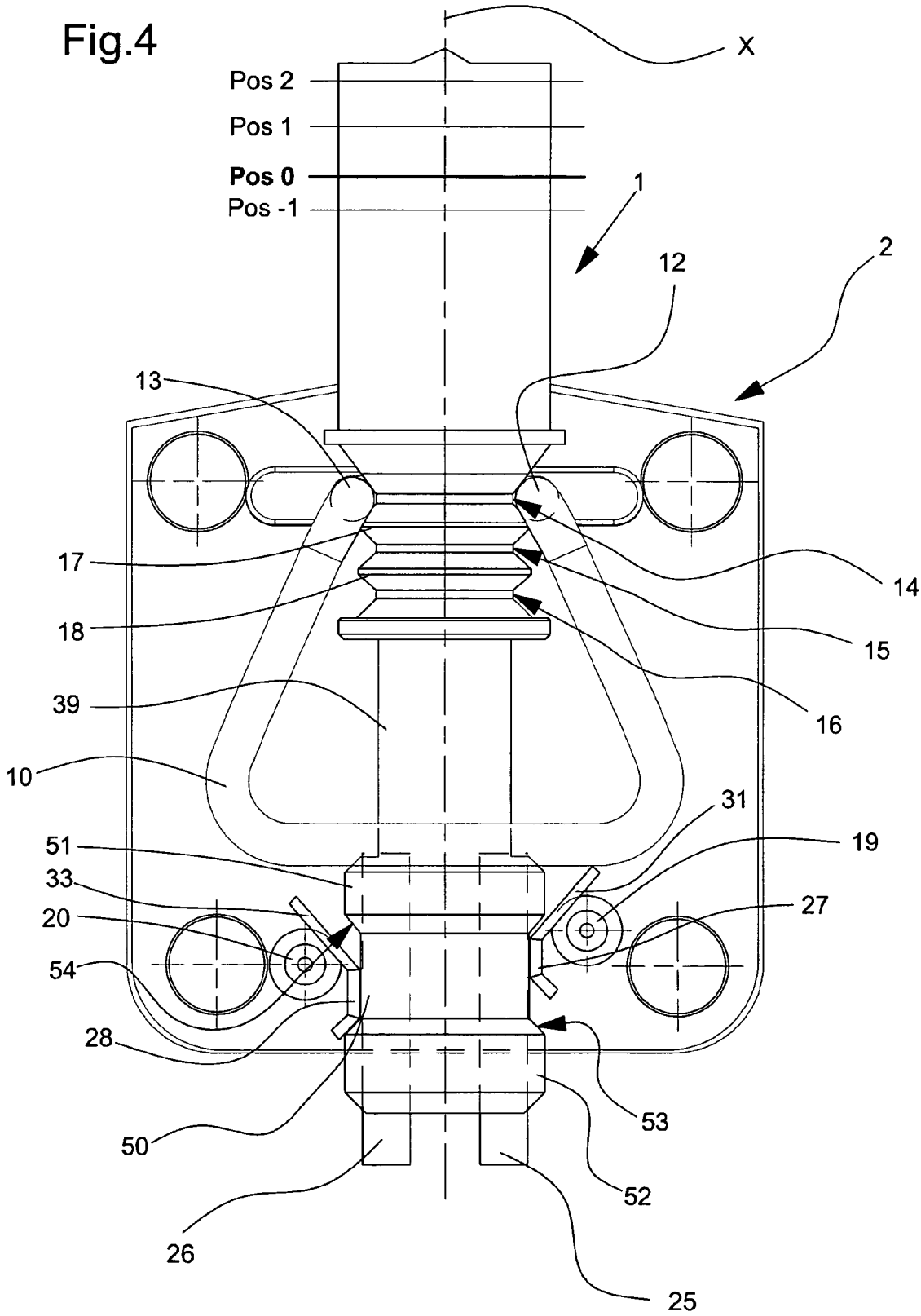
FIG. 4 is a view similar to the view of FIG. 2, showing schematically an alternative realisation of the control device according to the first embodiment of the present invention.

FIG. 4 shows a variant realisation of the present invention in a schematic manner, with a structure similar to that described in relation to the first embodiment, but whose functioning is inverse. In order to assist understanding, only the differences from the preceding embodiment will be dealt with in detail. Furthermore the reference numerals of the preceding figures have been retained for the identical elements.

It can be provided that, when the stem 1 is in its neutral axial position, the extensions 27 and 28 are close to the axis of the stem, in abutment with a first cylindrical portion 50 of the stem of small cross-section S3. Thus, when the stem is moved into its different axial positions, the extensions are caused to slide on to supplementary cylindrical portions 51 and 52 of greater cross-section S4 than that of the first portion 50. The passages from one cylindrical portion to another likewise take place via the slope of frustoconical portions 53 and 54.

More specifically, when the stem is in its neutral position, the two extensions 27 and 28 are in abutment with the cylindrical portion 50 and there is no contact with the respective connector studs 19 and 20.

When the stem is in its pushed-in axial position, the extension 27 comes into abutment with the cylindrical portion 51 and the contact clip 21 is thus deformed, so as to come into contact with the connector stud 19. The contact clip 22 is not deformed relative to the neutral position and thus does not make contact with the connector stud 20.

When the stem is in its first pulled-out axial position, the extension 28 comes into contact with the cylindrical portion 52 and the contact clip 22 is thus deformed and makes contact with the connector stud 20. The contact clip 21 is not deformed relative to the neutral position and thus does not make contact with the connector stud 19.

When the stem is moved from its first pulled-out axial position towards the second pulled-out position, the extension simply slides along the cylindrical portion 52 while maintaining electrical contact of the tongue 33 with the connector stud 20. At the same time, the contact clip 21 is deformed following the passage of the extension 27 from the first cylindrical portion 50 to the cylindrical portion 52 of greater cross-section. As a result the tongue 31 is brought into contact with the connector stud 19. Thus, in the second pulled-out axial position of the stem, both the contact clips 21 and 22 make electrical contact, with the connector studs 19 and 20 respectively.

As a result, in such a configuration, the connector studs 19 and 20 should be located further from the axis of the stem than the tongues 31 and 33, such that contact is made when the extensions 27 and 28 are moved away from the axis of the stem.

Figure 5:
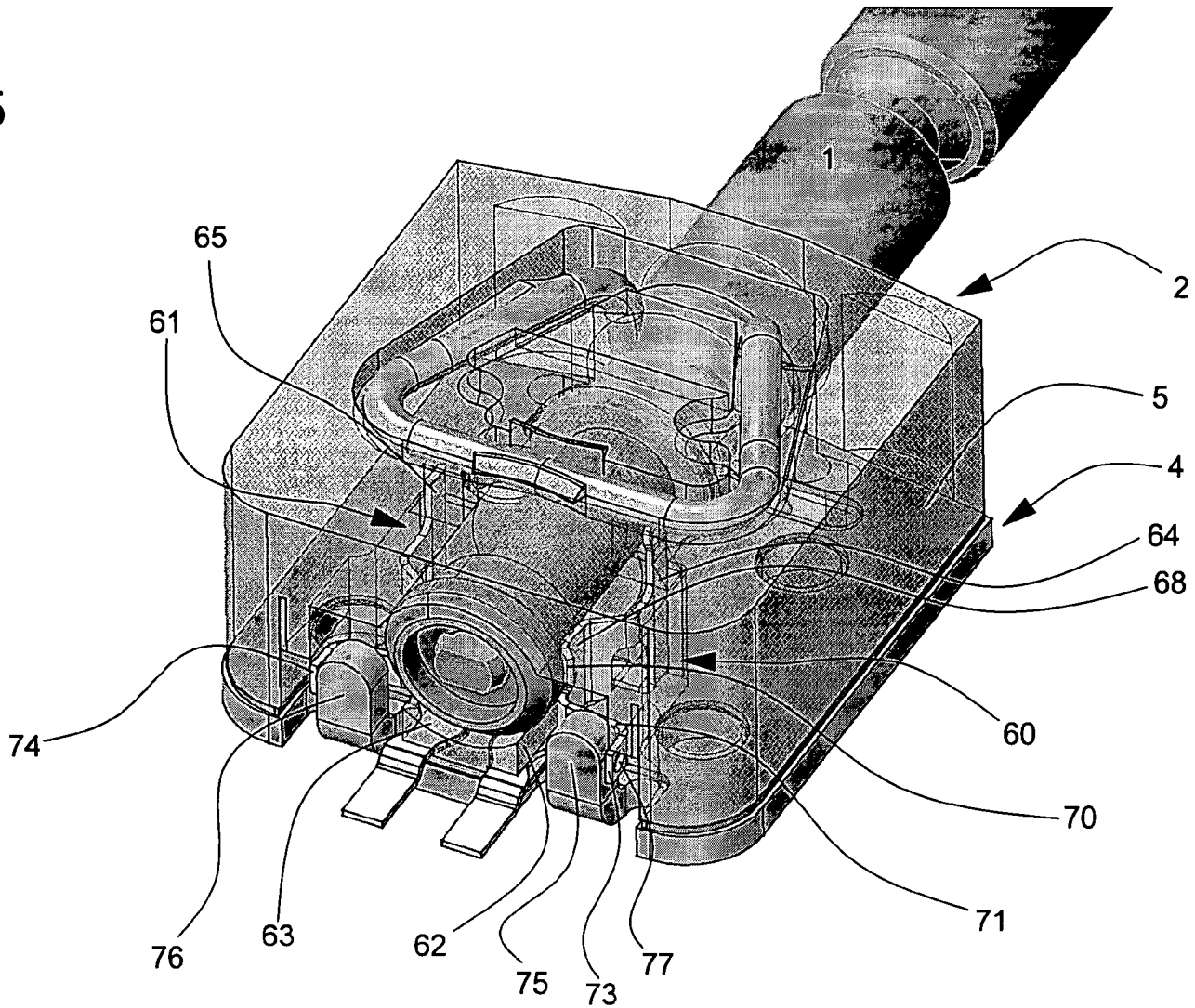
FIG. 5 is a view similar to the view of FIG. 1 showing a second preferred embodiment of the present invention.
Figure 6:
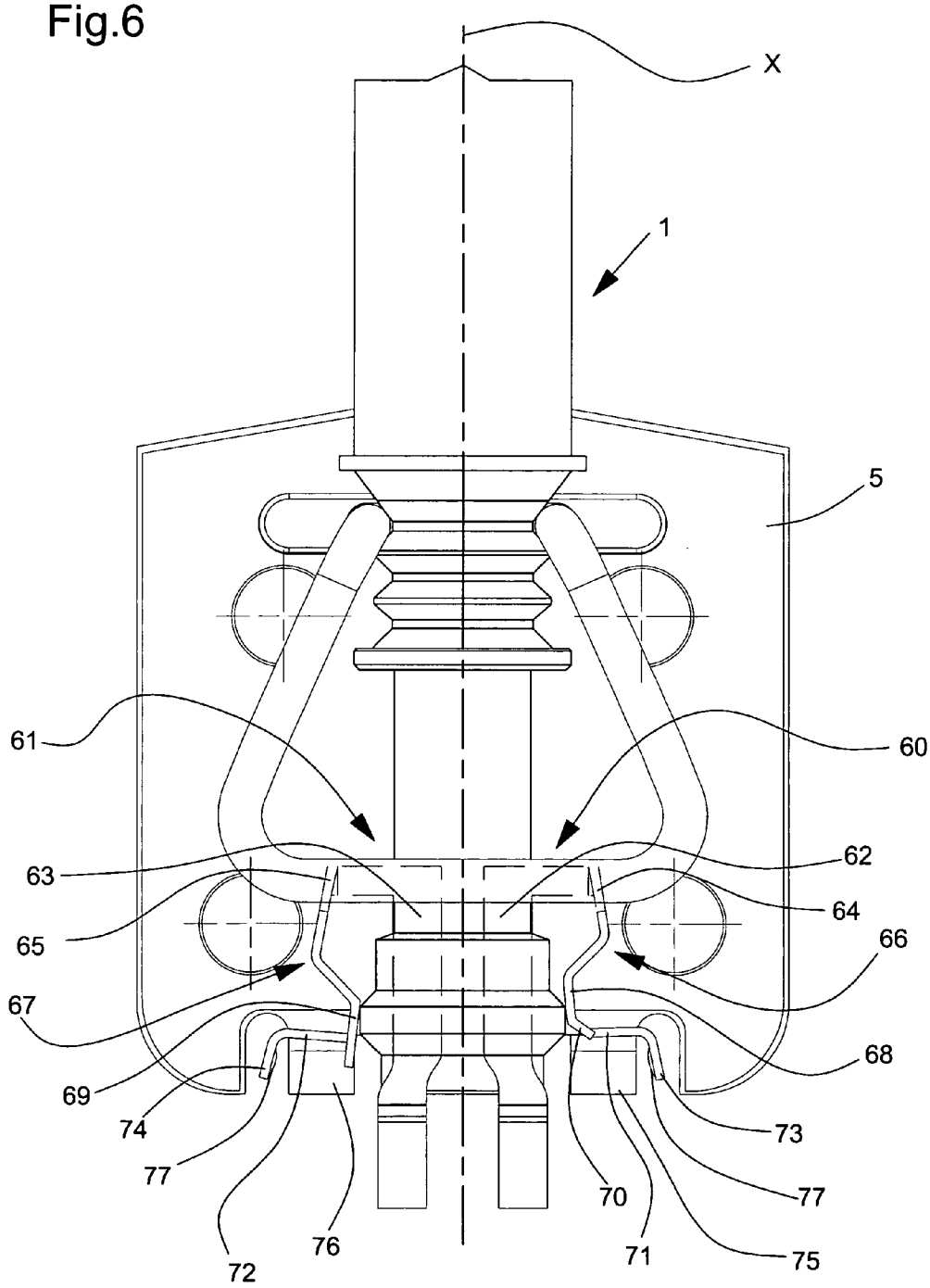
FIG. 6 is a simplified view from above of the device of FIG. 5.

A second preferred embodiment of the control device according to the present invention is shown in FIGS. 5 and 6. In this embodiment the contact clips have a significantly different structure from that described above, as do the electrical connector studs, but the operation of the functioning of the device remains similar, in particular in respect of the principle. FIG. 5 shows the stem 1 in its pushed-in position (Pos −1) while FIG. 6 shows the stem 1 in its neutral position (Pos 0).

The clips 60, 61 each have a base 62, 63 disposed on the first layer 5 of the plate 4 and extending in a general direction substantially parallel to the axis X of the stem 1. Each of the bases 62, 63 comprises a bent portion in the region of its end inside the module 2, from which extends an extension 64, 65 in a direction substantially perpendicular to the plate 4. It is noted that the extensions 64 and 65 are thus situated on one side and the other of the stem 1. Each of the extensions 64, 65 comprises an incurved arm 66, 67 extending alongside the stem 1 in the direction of the end thereof located inside the module 2. Each of the arms 66, 67 comprises a contact region 68, 69 defined by a deformation of the corresponding arm towards the stem and adapted to be disposed in contact with the latter in certain of its axial positions.

These contact regions 68 and 69 cooperate with the cylindrical sections of the stem 1, as described previously, in such a manner as to deform the respective contact clips so as to modify their electrical state. To this end it may be noted that the two contact regions 68 and 69 are offset from one another in the direction of the axis X of the stem.

It is noted that the contact region 68 of the contact clip 60 terminates in a short portion 70, bent away from the stem. The function of the bent portion 70 has already been described above in relation to the first embodiment and consists in improving the sliding of the frustoconical portions of the stem on the arm 66 in certain positions.

Each of the arms 66, 67 further comprises a supplementary extension 71, 72 extending away from the stem after the corresponding contact region, in a direction substantially perpendicular to the latter and terminating in a bent distal portion 73, 74.

On the other hand contact tabs 75, 76 are formed integrally with the second layer 6 of the plate 4, by deformation of material so as to extend towards the stem in a direction substantially perpendicular to the plate 4. The tabs 75, 76 perform the function of the connector studs 19 and 20 described above, while allowing simplification of their manner of manufacture to the extent that they are simply obtained by deformation of material.

Thus it is noted that the distal portions 73 and 74 are situated close to the tabs 75 and 76 respectively and are adapted to make contact with the latter by deformation of the contact clips 60, 61. To illustrate this in the case of the Figure, the contact clip 60 has been shown in such a configuration, i.e. when the distal portion 73 is in contact with the tab 75.

A pip 77 has been provided in an advantageous manner on each of the distal parts 73, 74, to improve the quality of the respective electrical contacts with the tabs 75 and 76.

It can be seen that the electrical states of the assembly formed by the two contact clips 60 and 61 are identical with those described above in relation to the first embodiment.

It can further be seen that the present embodiment has an additional advantage relative to the preceding because of the kind of deformation undergone by the contact clips during the movements of the stem between its different axial positions. Thus, the contact clips 60 and 61 are subjected to torsional deformations in the regions of the extensions 64 and 65, about an axis substantially orthogonal to the X axis, while the contact clips 21 and 22 of the first embodiment are subjected to flexural deformations in the region of the extensions 27 and 28. Since the torsional deformations are more advantageous in the long term than the flexural deformations, from the point of view of the element which undergoes them, the present embodiment is preferred to the first.

In general terms, it can be seen that the module 2 comprises, in an advantageous manner, holes 55 extending through the plate 4, visible in FIG. 1 but not shown for reasons of clarity in the other Figures, provided for effecting assembly of the module in the electronic apparatus by screws or rivets.

It can moreover be noted that the control device described above is—in a preferred but not obligatory manner—associated with means for detecting rotation of the stem 1. These means can be selected from any known type of rotation detection means for the stem compatible with the control device according to the present invention, these means being optionally adapted to detect the direction of rotation of the stem, as well as its speed of rotation.

By way of example, the man skilled in the art can refer to the previously cited patent U.S. Pat. No. 6,203,190 for example, in which a device for detecting the rotation of the stem functioning in several axis positions of the said stem is described. Likewise, the U.S. Pat. No. 4,379,642 issued 12th Apr. 1983 discloses a similar device for detecting the rotation of a stem in an electronic apparatus.

The foregoing description relates to two preferred embodiments and should not in any case be regarded as limiting, in respect of that which more particularly concerns the described and illustrated form of the various structural parts making up the control device, as well as their respective dispositions.

By way of example, it may be provided that the contact clips 21, 22 and 60, 61 are located opposite a region of the stem other than its end, even if such a solution is less advantageous than that described from the point of view of the space required.

A different realisation of the contact clips can equally be provided, such as mounting each of the extensions on a hinge in contact with a spring exerting a biasing force on it in the direction of the stem for example. However, this solution is less advantageous from the point of view of manufacturing costs, to the extent that each contact clip comprises a plurality of parts which makes it more complex and which requires special assembly operations.

The possible applications of such a control device are very numerous, since the present invention can be implemented for any, type of electronic apparatus requiring means for entering data, in particular for an electronic wrist watch, for example.

What is claimed is:

1. A control device for electronic apparatus, comprising a stem with an axis X, said stem being shiftable along said axis between at least four different axial positions, wherein said device comprises two contact clips, each comprising a movable contact element adapted to be displaced between at least two positions and to make electrical contact with an electrical power supply terminal in at least one of said positions, the two contact clips forming an assembly adapted to provide four different electrical states representative of respective said axial positions of the stem, said power supply terminals being connected to a same electrical conductor having, at least in the region of connection of said power supply terminals, the shape of a plane substantially parallel to said axis X, wherein the movable contact elements are disposed respectively on one side and the other of the stem.

2. The device according to claim 1, wherein each of said movable contact elements is formed by an extension deformable in elastic manner in a direction substantially perpendicular to the direction of the axis X, said extensions being offset in the direction of the axis X of the stem.

3. The device according to claim 1, wherein each of said movable contact elements is formed by an extension deformable in elastic torsional manner about an axis substantially orthogonal to the direction of the axis X.

4. The device according to claim 1, wherein said movable contact element comprises a tongue inclined relative to the direction of the axis X in such a manner as to extend away therefrom and capable of being arranged in abutment with said power supply terminal, the latter being located between said inclined tongue and the stem.

5. The device according to claim 1, wherein said stem has a plurality of cylindrical axial portions with different respective cylindrical cross-sections, each of said movable elements being disposed in contact with one of said axial portions in at least one of its positions.

6. The device according to claim 3, wherein said stem has a plurality of cylindrical axial portions with different respective cylindrical cross-sections, each of said movable elements being disposed in contact with one of said axial portions in at least one of its positions and, wherein said contact clips have contact regions adapted to cooperate with said cylindrical axial portions of the stem and disposed in such a manner as to be offset in the direction of the axis X of the stem.

7. The device according to claim 5, wherein frustoconical portions are formed on said stem at least at the junctions between two successive cylindrical axial portions.

8. The device according to claim 6, wherein frustoconical portions are formed on said stem at least at the junctions between two successive cylindrical axial portions.

9. The device according to claim 1, wherein it further comprises a spring whose ends cooperate with grooves and beads of the stem to locate the respective axial positions of the latter.

10. The device according to claim 3, wherein it further comprises a spring whose ends cooperate with grooves and beads of the stem to locate the respective axial positions of the latter.

11. The device according to claim 1, the stem being adapted to turn about the axis X, wherein the device further comprises means for detecting rotation of the stem.

12. The device according to claim 3, the stem being adapted to turn about the axis X, wherein the device further comprises means for detecting rotation of the stem.

13. The device according to claim 12, wherein said means for detecting rotation of the stem are further adapted to determine the direction of rotation of the stem and/or its speed of rotation.

* * * * *